US012723751B2

(12) United States Patent
O'Donnell

(10) Patent No.: US 12,723,751 B2
(45) Date of Patent: Sep. 1, 2026

(54) COMBUSTOR

(71) Applicant: BECKETT THERMAL SOLUTIONS, North Ridgeville, OH (US)

(72) Inventor: Michael J. O'Donnell, Avon, OH (US)

(73) Assignee: BECKETT THERMAL SOLUTIONS, North Ridgeville, OH (US)

( * ) Notice: Subject to any disclaimer, the term of this patent is extended or adjusted under 35 U.S.C. 154(b) by 355 days.

(21) Appl. No.: 18/373,495

(22) Filed: Sep. 27, 2023

(65) Prior Publication Data

US 2024/0191874 A1 Jun. 13, 2024

Related U.S. Application Data

(60) Provisional application No. 63/430,693, filed on Dec. 7, 2022.

(51) Int. Cl.
*F23D 14/02* (2006.01)

(52) U.S. Cl.
CPC ..... *F23D 14/02* (2013.01)

(58) Field of Classification Search
CPC ..... F23D 14/02
USPC ..... 431/350
See application file for complete search history.

(56) References Cited

U.S. PATENT DOCUMENTS

| | | | | |
|---|---|---|---|---|
| 9,989,249 | B2 | 6/2018 | Bell | |
| 10,955,134 | B2 | 3/2021 | O'Donnell | |
| 11,708,973 | B2 | 7/2023 | O'Donnell | |
| 2009/0017407 | A1* | 1/2009 | Fogliani | F23D 14/105 431/350 |
| 2010/0291495 | A1* | 11/2010 | Scribano | F23D 14/105 431/174 |
| 2014/0186784 | A1 | 7/2014 | Cook et al. | |
| 2015/0099232 | A1* | 4/2015 | Neumeier | F23D 14/70 239/402.5 |
| 2015/0153041 | A1* | 6/2015 | Neumeier | F23D 14/02 239/405 |
| 2019/0128516 | A1 | 5/2019 | O'Donnell | |
| 2021/0388981 | A1 | 12/2021 | O'Donnell | |

FOREIGN PATENT DOCUMENTS

| | | |
|---|---|---|
| CN | 214038406 U | 8/2021 |
| EP | 3719396 A1 | 7/2020 |

OTHER PUBLICATIONS

European EP23207497 Extended European Search Report—Apr. 23, 2024.

* cited by examiner

*Primary Examiner* — Avinash A Savani
(74) *Attorney, Agent, or Firm* — Tucker Ellis LLP

(57) ABSTRACT

A combustor includes an outer tube having an interior space extending between first and second openings. An inner tube within the interior space extends along a centerline from a first end to a second end and defines a central passage. The first end is closed by an end wall in a fluid-tight manner. The interior space is supplied with a mixture of air and combustible fuel pre-mixed upstream of the inner tube. The inner tube has fluid directing structures for directing the pre-mixed mixture radially inward from the interior space to the central passage such that the pre-mixed mixture converges towards the central axis in a direction extending towards the second end of the inner tube.

24 Claims, 9 Drawing Sheets

COMBUSTOR

RELATED APPLICATIONS

This application claims the benefit of U.S. Provisional Appln. Ser. No. 63/430,693, filed Dec. 7, 2022, the entirety of which is incorporated by reference herein.

TECHNICAL FIELD

The invention relates to a combustor and, in particular, relates to a combustor for a heating appliance that axially directs combustion air or a combination of air and fuel.

BACKGROUND

Power burners of various types have been in use for many years. "Nozzle mix" or "gun style" burners are those burners that inject fuel and air separately in some manner so as to provide a stable flame without a ported flame holder component. Other types of power burners use some method of pre-mixing the fuel and air and then delivering the fuel-air mixture to a ported burner "head". These "heads" or "cans" can be made of a variety of materials including perforated sheet metal, woven metal wire, woven ceramic fiber, etc. Flame stability, also referred to as flame retention, is key to making a burner that has a broad operating range and is capable of running at high primary aeration levels. A broad operating range is desired for appliances that benefit from modulation, in which the heat output varies depending on demand. High levels of primary aeration are effective in reducing $NO_x$ emissions, but tend to negatively impact flame stability and potentially increase the production of Carbon Monoxide (CO). High levels of primary aeration (also referred to as excess air) also reduce appliance efficiency. There is a need in the art for a combustor that reduces the production of NOx while maintaining flame stability. Even more desirable is a burner that produces very low levels of NOx while operating at low levels of excess air.

SUMMARY

In one example, a combustor includes an outer tube having an interior space extending between first and second openings. An inner tube within the interior space extends along a centerline from a first end to a second end and defines a central passage. The first end is closed by an end wall in a fluid-tight manner. The interior space is supplied with a mixture of air and combustible fuel pre-mixed upstream of the inner tube. The inner tube has fluid directing structures for directing the pre-mixed mixture radially inward from the interior space to the central passage such that the pre-mixed mixture converges towards the central axis in a direction extending towards the second end of the inner tube.

In another example, a combustor includes an outer tube defining an interior space extending between first and second openings. An inner tube within the interior space extends along a centerline from a first end to a second end and defines a central passage. The interior space is supplied with a mixture of air and combustible fuel pre-mixed upstream of the inner tube. The inner tube has fluid directing structures for directing the pre-mixed mixture radially inward from the interior space to the central passage such that the pre-mixed mixture converges towards the central axis in a direction extending towards the second end of the inner tube. An end wall secures the first end of the inner tube to the outer tube in a fluid-tight manner such that the fluid directing structures on the inner tube provides a fluid path from the interior space to the central passage. A flange secures the second end of the inner tube to the outer tube in a fluid-tight manner.

In another example, a combustor for an appliance includes an inner tube extending along a central axis. The inner tube defines a central passage and includes fluid directing structures arranged circumferentially thereon. An outer tube extends along the central axis and defines a central passage for receiving the inner tube. A fluid passage is defined between the inner and outer tubes. A partition divides the central passage of the inner tube into a first section and a second section. An end wall closes the fluid passage at the first ends of the inner and outer tubes. The first end of the inner tube receives a pre-mixed mixture of air and combustible fuel such that the pre-mixed mixture flows radially outward through the fluid directing structures into the fluid passage and then radially inward into the second section of the central passage downstream of the partition for ignition by an igniter.

Other objects and advantages and a fuller understanding of the invention will be had from the following detailed description and the accompanying drawings.

DETAILED DESCRIPTION

The invention relates to a combustor and, in particular, relates to a combustor for a heating appliance that axially directs combustion air or a combination of air and fuel.

FIGS. 1-4 illustrate a fuel burner or combustor 10 in accordance with the present invention. The combustor 10 can be used in industrial, household, and commercial heating appliances such as, for example, a water heater, boiler, furnace, etc. The combustor 10 can also be used in non-appliance applications, e.g., in a jet engine. With that in mind, an example jet engine for use with the combustors shown and described herein is detailed in U.S. Pat. No. 10,634,354, filed Nov. 22, 2016, the entirety of which is incorporated by reference herein.

Figure 1:
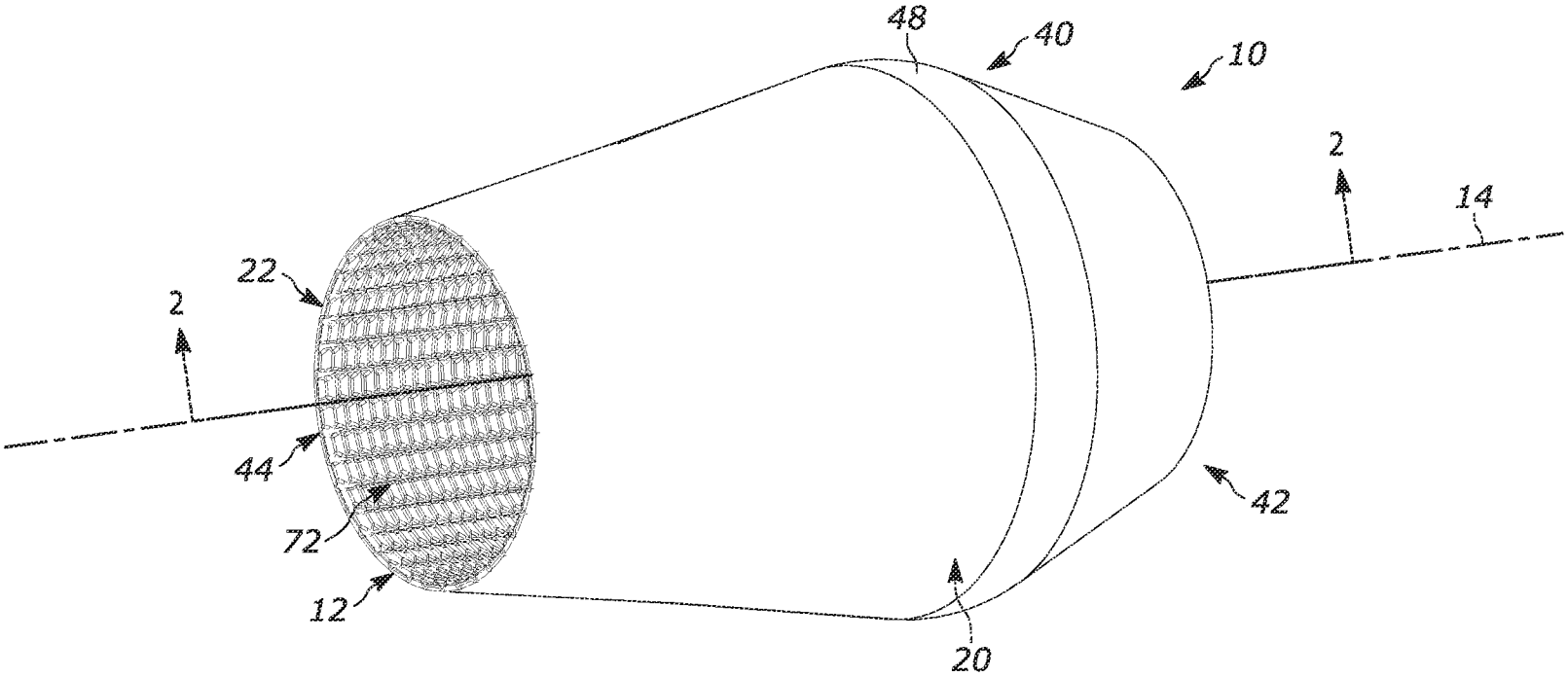
FIG. 1 is a schematic illustration of a combustor in accordance with an aspect of the present invention.
Figure 2:
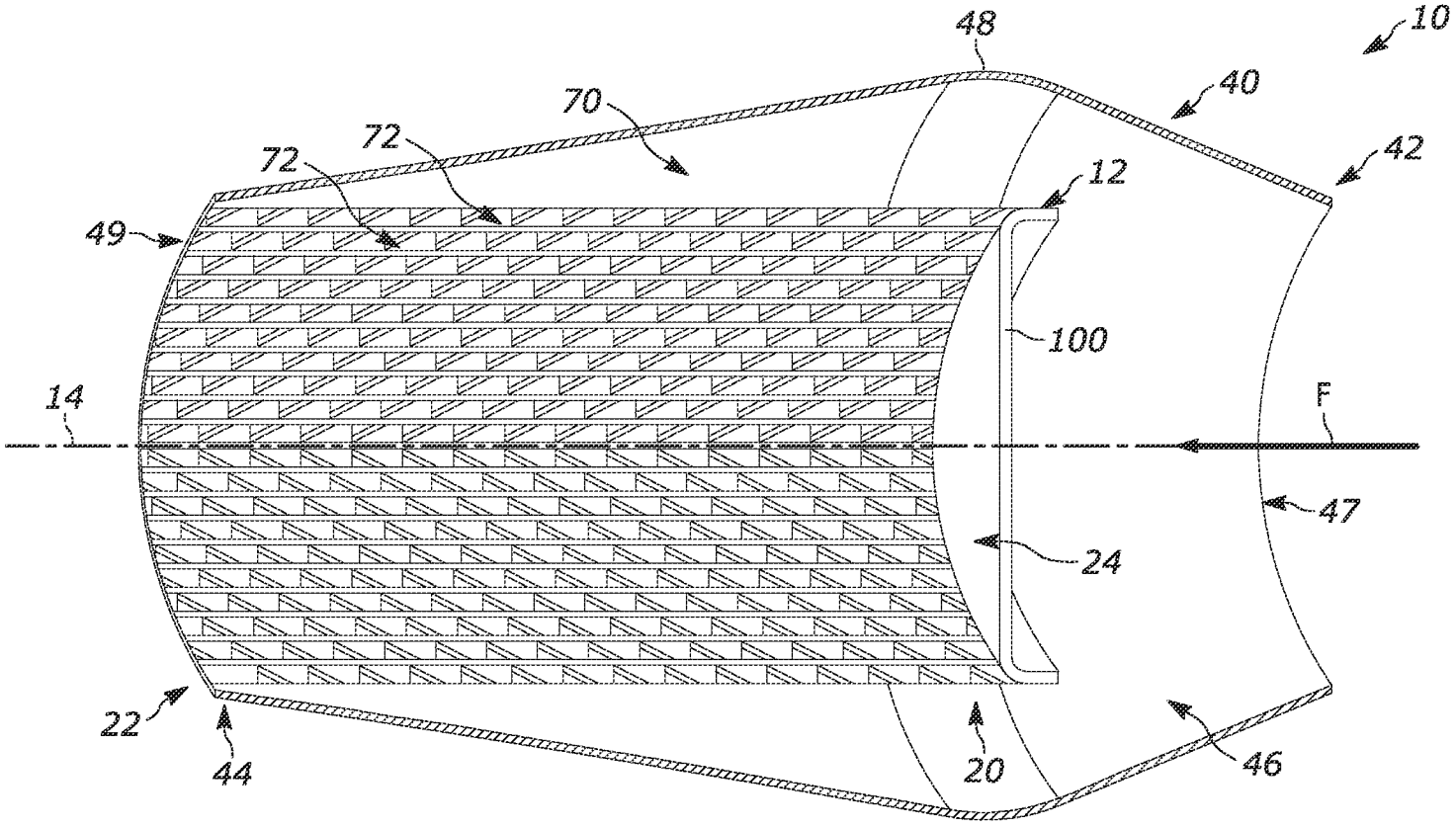
FIG. 2 is a section view taken along line 2-2 of FIG. 1.

Referring to FIGS. 1-2, the combustor 10 includes a first, inner tube 12 and a second, outer tube 40. The inner tube 12 and the outer tube 40 are concentric with one another and are centered about a central axis 14. The inner tube 12 extends along the central axis 14 from a first end 20 to a second end 22. Although the inner tube 12 is illustrated as having a circular shape, it will be appreciated that the inner tube can exhibit alternative shapes, such as triangular, square, oval, any polygonal shape or combinations thereof along its length.

A central passage or interior space 24 extends the length of the inner tube 12 from the first end 20 to the second end 22. The inner tube 12 has a constant cross-section as illustrated in FIG. 1. Alternatively, the inner tube 12 can have a cross-section that varies (not shown), e.g., is stepped, tapered, etc., in one or more directions along the central axis 14. Regardless, the inner tube 12 is made from a durable, flame-resistant material, such as metal.

The outer tube 40 extends along the central axis 14 from a first end 42 to a second end 44. Although the outer tube 12 is illustrated as having round axial cross-section, it will be appreciated that the outer tube can exhibit alternative cross-sections, such as triangular, square, oval, any polygonal shape or combinations thereof along its length. A central passage or interior space 46 extends the length of the outer tube 40 from the first end 42 to the second end 44. The interior space 46 terminates at an opening 47 at the first end 42 and at an opening 49 at the second end 44.

The outer tube 40 can have a cross-section that varies along the central axis 14. As shown, the outer tube 40 tapers radially outward from the first end 42 towards the second end 44 until reaching a transition portion 48. The outer tube 40 tapers radially inward from the transition portion 48 to the second end 44. Alternatively, the outer tube 40 can have a uniform cross-section along the central axis 14. In any case, the outer tube 40 is made from a durable, flame-resistant material, such as metal.

The inner tube 12 is positioned within the interior space 46 of the outer tube 40 such that the first end 20 of the inner tube generally within or adjacent to the transition portion 48 of the outer tube. A lip or flange 50 (see FIG. 4) at the second end 44 of the outer tube 40 is bent into a u-shaped configuration to secure the second end 44 of the outer tube to the second end 22 of the inner tube 12 in a fluid-tight manner such that fluid cannot flow directly from the interior space 46 out of the second opening 49 in the outer tube 40. Alternatively/additionally, the second end 44 can be secured via adhesive, welding or the like to the second end 22 in a fluid-tight manner.

Figure 4:
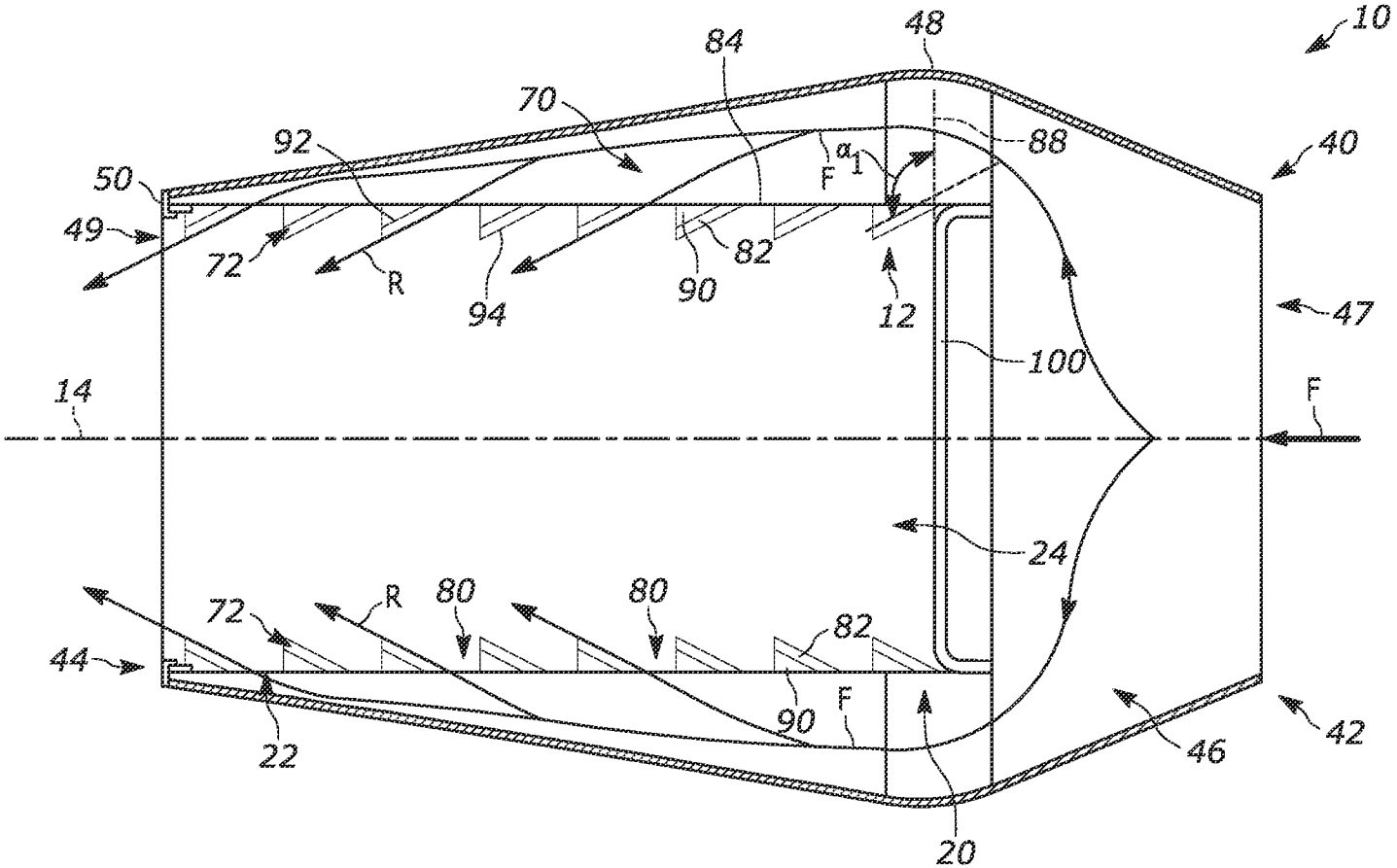
FIG. 4 is a schematic illustration of operation of the combustor of FIG. 1.

The space between the inner and outer tubes 12, 40 defines a fluid passage 70 for receiving a pre-mixed mixture of fuel and air. As shown in FIG. 2, the periphery of the inner tube 40 includes fluid directing structure or structures 72 for directing fluid to the central passage 24. As shown in FIG. 4, the fluid directing structures 72 are configured to direct the air/fuel mixture radially inward to the central passage 24 in a direction that converge towards the central axis 14 and towards the second end 22 of the inner tube 12.

Figure 3:
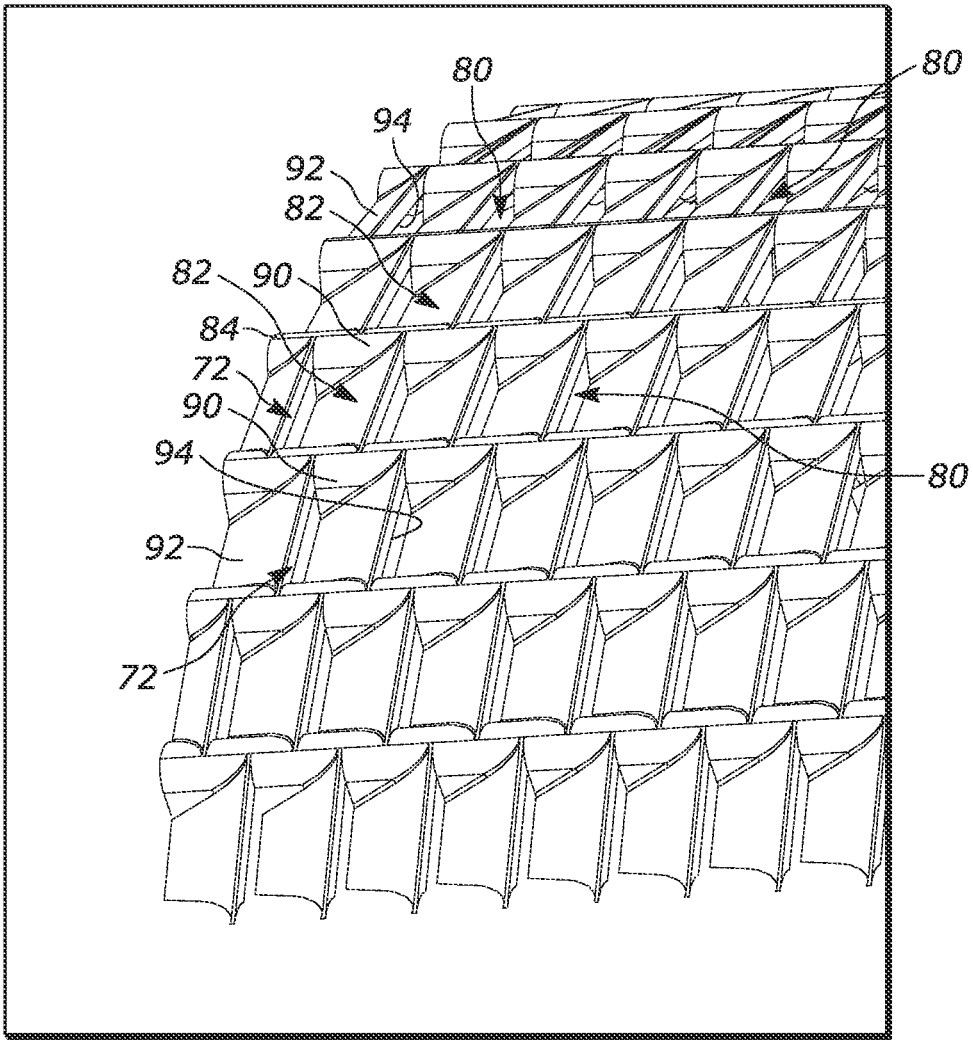
FIG. 3 is an enlarged view of a portion of fluid directing structures of the combustor of FIG. 1.

The fluid direction structure 72 can include a series or openings with associated fins or guides for directing fluid in the desired manner. As shown in FIG. 3, the fluid directing structures 72 include a plurality of openings 80 in the inner tube 12 for allowing the air/fuel mixture to pass from the fluid passage 70 to the central passage 24. Each opening 80 extends radially entirely through the inner tube 12. Each opening 80 can have any shape, such as rectangular, square, circular, triangular, etc. The openings 80 can all have the same shape or different shapes.

The openings 80 are aligned with one another along the length of the inner tube 12 to form rows. One or more rows of openings 80 can be positioned adjacent to one another or spaced from one another around the periphery, e.g., circumference, of the inner tube 12. Each row can have any number of openings 80. The openings 80 in adjacent rows can be aligned with one another in the circumferential direction or can be offset from one another. As shown, every other row of openings 80 is aligned with one another such that the openings in adjacent rows are longitudinally offset from one another. The size, shape, configuration, and alignment of the openings 80 in the inner tube 12 is dictated by desired flow and performance characteristics of the air/fuel mixture flowing through the openings. Although the openings 80 are illustrated as being arranged in a predetermined pattern along the inner tube 12, it will be appreciated that the openings can be randomly positioned along the inner tube (not shown).

Each opening 80 includes a corresponding fluid directing projection or guide 82 for directing the air/fuel mixture passing through the associated opening radially inward into the central passage 24 in a direction extending towards the central axis 14 and towards the second end 22 of the inner tube 12. In other words, the fluid directing structures 72 direct the air/fuel mixture radially inward and downstream towards the second end 22 of the inner tube 12.

The guides 82 are formed in or integrally attached to the inner tube 12. Sidewalls 90 further connect the guides 82 to the inner tube 12. Each guide 82 includes an outer surface 92 and an opposing inner surface 94 extending substantially parallel to the outer surface. Each guide 82 extends radially inward into the central passage 24 and toward the centerline 14 at an angle, indicated at $\alpha_1$, relative to an axis 88 extending normal to the outer surface 84 of the inner tube 40 (see FIG. 4). The angle $\alpha$ is measured to the outer surface 92 of the guide 82. The guides 82 can extend at the same angle $\alpha_1$ or at different angles relative to the outer surface 84. In any case, the angle $\alpha_1$ is less than 180° such that guides 82 extend towards the second end 22 of the inner tube 12.

Although the figures show each opening 80 having an associated guide 82, it should be noted that openings with other configurations can be used. For example, straight-through openings 80—without accompanying guides 82—can extend towards the central axis 14 and be interspersed with guided openings to achieve the same overall effect. It will also be appreciated that adjacent guides 82 in the same row can cooperate to direct the air/fuel mixture in the desired manner, e.g., the inner surface 94 of one guide 82 and the outer surface 92 of the adjacent guide 82 can cooperate to direct the air/fuel mixture in the manner described.

Referring to FIG. 4, an end wall 100 is secured to the first end 20 of the inner tube 12 in a fluid-tight manner such that fluid cannot flow directly into the central passage 24 of the inner tube 12 from the interior space 46 of the outer tube 40. A fully pre-mixed mixture of combustible fuel and air is delivered to the central passage 24 as shown generally by the arrow F in a conventional manner known in the art. For instance, the pre-mixed mixture F can be supplied by a blower (not shown) attached directly to the upstream/inlet end 20 of the combustor 10. Alternatively, a duct or channel (not shown) can connect said blower to the upstream/inlet end 20 of the combustor 10.

The end wall 100 prevents the pre-mixed mixture F from entering the first end 20 of the tube 12 except through the fluid directing structures 72. Consequently, the pre-mixed mixture F flows around the end wall 100 into the fluid passage 70. Since the flange 50 forms a fluid-tight seal with the second end 22 of the tube 12, the pre-mixed mixture F is directed radially inward through the fluid directing structures 72 into the central passage 24. As this occurs, the pre-mixed mixture F is also directed downstream towards the second end 22 of the tube 12 and towards the centerline 14 due to the angle α of the guides 82. As a result, the pre-mixed mixture F converges or focuses towards the centerline 14 in a direction extending towards the outlet end of the combustor 10.

The combustor 10 may be specifically configured to restrict fluid flow therethrough to what has been described. In these configurations, the end wall 100 prevents the pre-mixed mixture F and any flame produced within the central passage 24 from exiting the central passage through the first end 20 of the tube 12. Consequently, the pre-mixed mixture F can only enter the central passage 24 by passing through the fluid directing structures 72.

That said, the combustion products from the ignited air/fuel mixture exit the combustor 10 focused towards the central axis 14 of the combustor as indicated generally by arrows R in FIG. 4. The focused air/fuel mixture R is ignited by an ignition device (not shown) of any number of types well known in the art and positioned in any number of suitable locations to light the combustor 10. For example, the end wall 100 can be provided with an opening (not shown) through which an igniter extends. Flame proving means (not shown) can be positioned in any number of suitable locations to detect the presence of flame. A controller (not shown) can be connected to the blower, igniter, and flame proving means for controlling and monitoring the same.

It will also be appreciated that the end wall 100 can include one or more openings (not shown) to allow a portion of the incoming pre-mixed mixture F to flow therethrough to the central passage 24. At the same time, the remainder of the pre-mixed mixture F flows around the end wall 100, into the fluid passage 70, and through the fluid directing structures 72 into the central passage 24 in a direction that is radially inward and downstream towards the second end 22 of the inner tube 12. In this configuration, the portion of the pre-mixed mixture F flowing through the openings in the end wall 100 mix with the portion of the pre-mixed mixture flowing through the fluid directing structures 72 to form a collective mixture that is ignited by an igniter.

Figure 5:
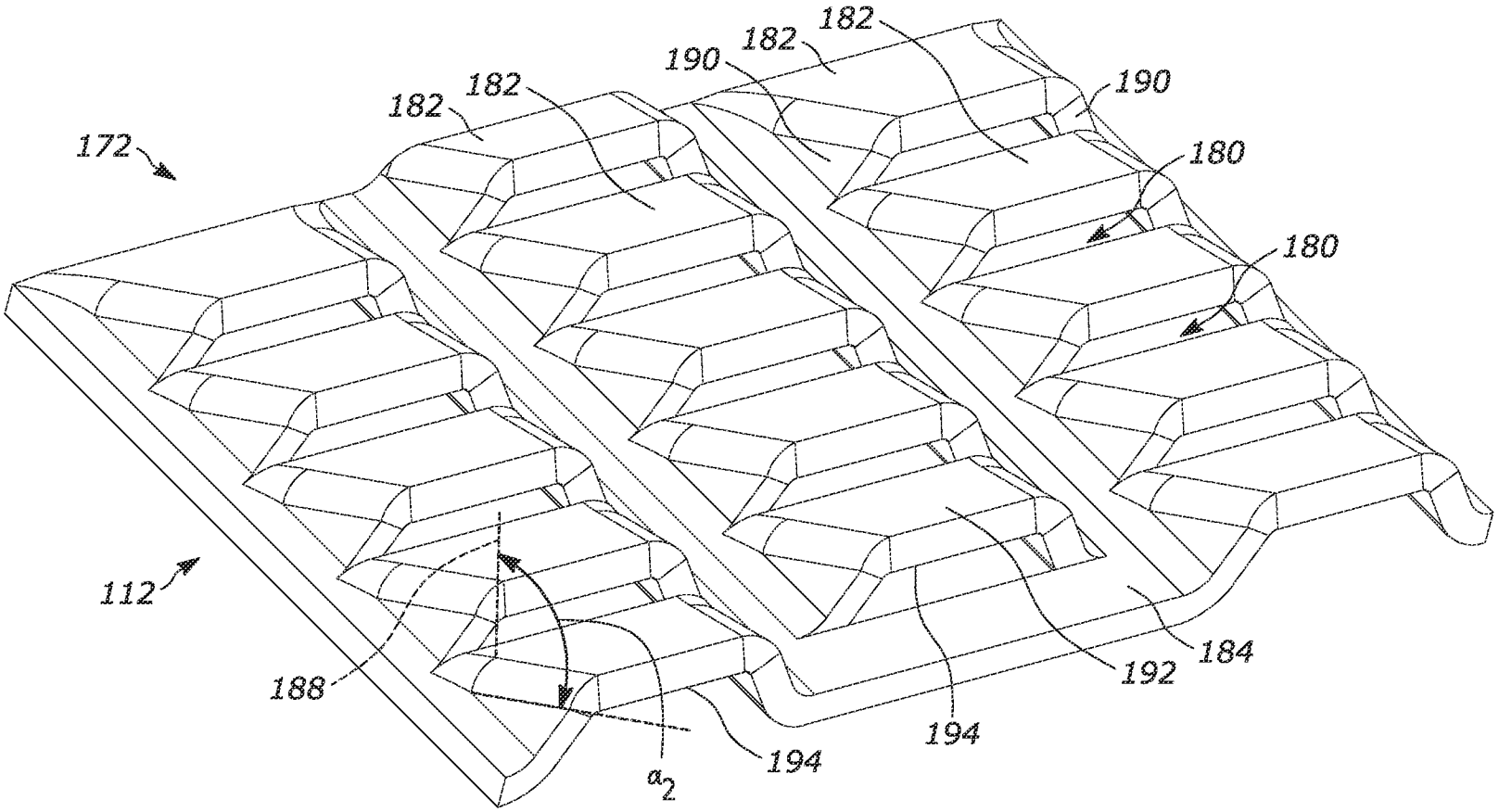
FIGS. 5-6B are enlarged views of portions of alternative fluid directing structures in accordance with the present invention.
Figure 6A:
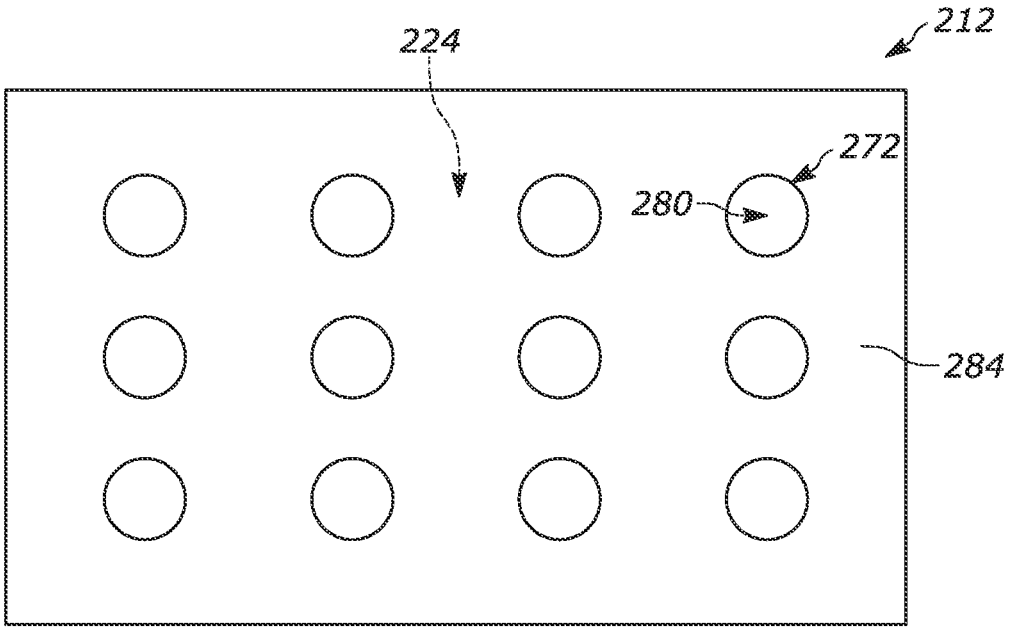
Figure 6B:
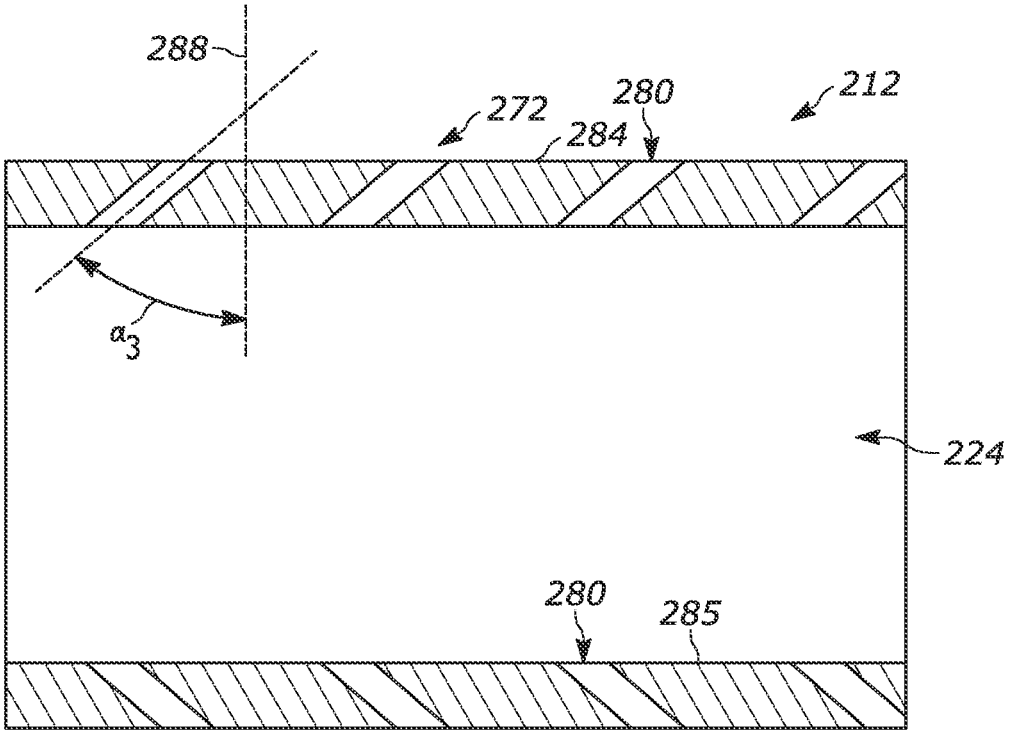

FIGS. 5-6B illustrate alternative configurations of the fluid directing structures on the inner tube in accordance with the present invention. Features in each alternative configuration are given reference numbers 100, 200, etc., greater than the corresponding, similar feature in FIGS. 1-4. In each case, the fluid directing structures directs the pre-mixed mixture F radially inward towards the central axis and towards the second end of the inner tube such that the pre-mixed mixture converges towards the central axis at/adjacent to the outlet of the combustor and exits the combustor 10 focused towards the central axis 14 in the manner R.

In FIG. 5, the fluid directing structures 172 includes a plurality of openings 180 and associated guides 182 on the inner tube 112 that extend radially into the interior of the inner tube. The openings 180 and guides 182 are arranged in a series of rows that extend the length of the inner tube 112. The rows are positioned adjacent to one another around the entire periphery of the inner tube 112. The guides 112 of adjacent rows can be longitudinally offset from one another (as shown) or longitudinally aligned with one another (not shown). The guides 182 in each row can be similar or dissimilar to one another. As shown, every other row of openings 180 is aligned with one another such that the openings in adjacent rows are longitudinally offset from one another.

Sidewalls 190 help to connect the guides 182 to the inner tube 112. Each guide 182 includes an outer surface 192 and an opposing inner surface 194 extending substantially parallel to the outer surface. The guides 182 in FIG. 5 extend radially outward from the inner tube 112 at the angle α relative to the axis 188 extending normal to the outer surface 184 of the inner tube. The angle $\alpha_2$ is measured to the inner surface 194 of the guide 182. As a result, the guides 182 direct the incoming pre-mixed mixture F through the openings 180 radially inward towards the centerline and towards the second end of the inner tube 112. The guides 182 can extend at the same angle $\alpha_2$ or at different angles relative to the outer surface 184. In any case, the angle $\alpha_2$ is less than 180° such that guides 182 extend towards the second end of the inner tube 112.

Although the figures show each opening 180 having an associated guide 182, it should be noted that openings with other configurations can be used. For example, straight-through openings 180—without accompanying guides 182—can extend towards the central axis 114 and be interspersed with guided openings to achieve the same overall effect. It will also be appreciated that adjacent guides 182 in the same row can cooperate to direct the air/fuel mixture in the desired manner, e.g., the inner surface 194 of one guide 182 and the outer surface 192 of the adjacent guide 182 can cooperate to direct the air/fuel mixture.

In FIGS. 6A-6B, the fluid directing structures 272 include a plurality of openings 280 that extend from the inner surface 285 of the inner tube 212 to the outer surface 284. The openings 280 are arranged in a series of rows that extend the length of the inner tube 212. The rows are positioned adjacent to one another around the entire periphery of the inner tube 212. The openings 280 in adjacent rows can be longitudinally aligned with one another (as shown) or longitudinally offset from one another (not shown). The openings 280 in each row can be similar or dissimilar to one another.

The depth of each opening 280 extends at an angle $\alpha_3$ relative to the axis 288 extending normal to the outer surface 284 of the inner tube 212. The angle $\alpha_3$ can be the same as either the angle $\alpha_1$ and/or the angle $\alpha_2$ but regardless is less than 180°. As a result, the openings 280 direct the incoming pre-mixed mixture F radially inward towards the centerline and towards the second end of the inner tube 212. No additional guides are associated with the openings 280 in FIGS. 6A-6B.

Figure 7A:
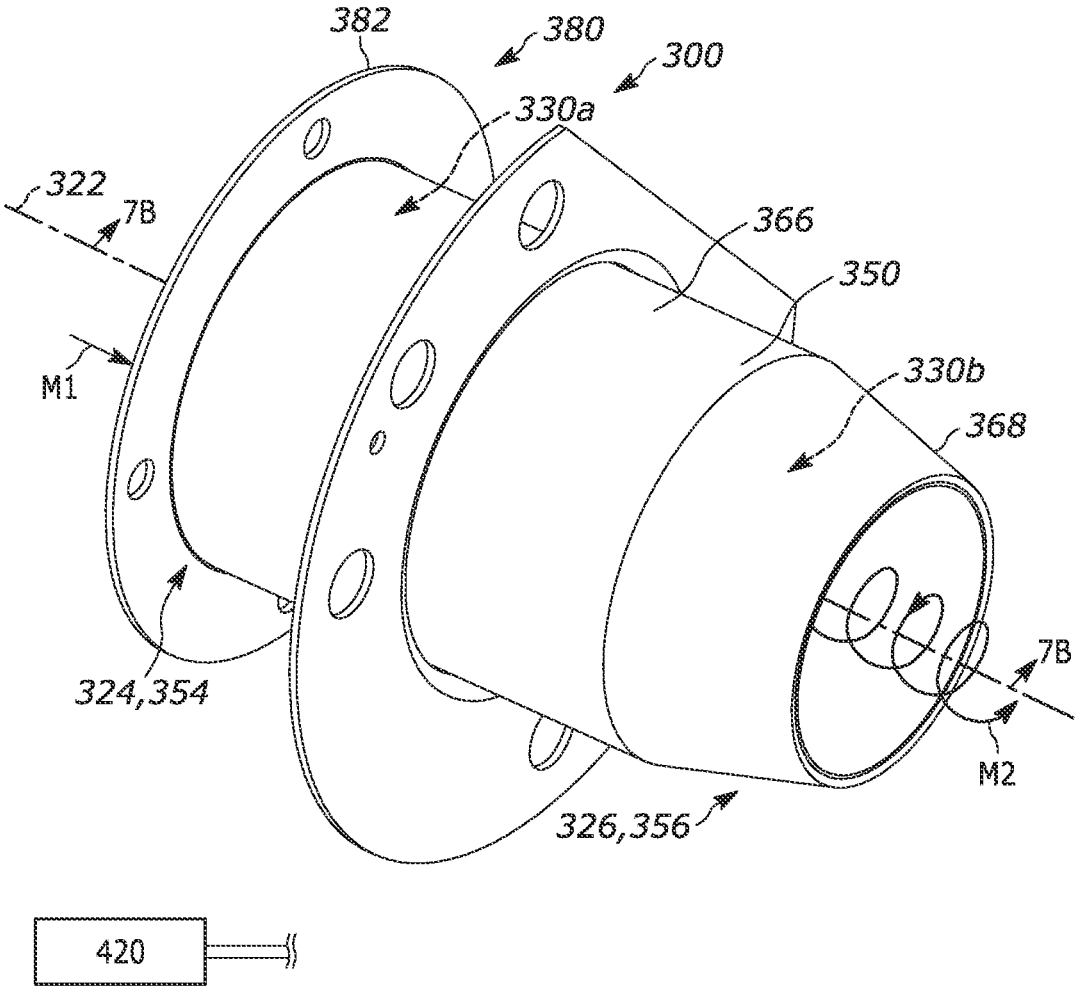
FIG. 7A is a schematic illustration of another example combustor.
Figure 7B:
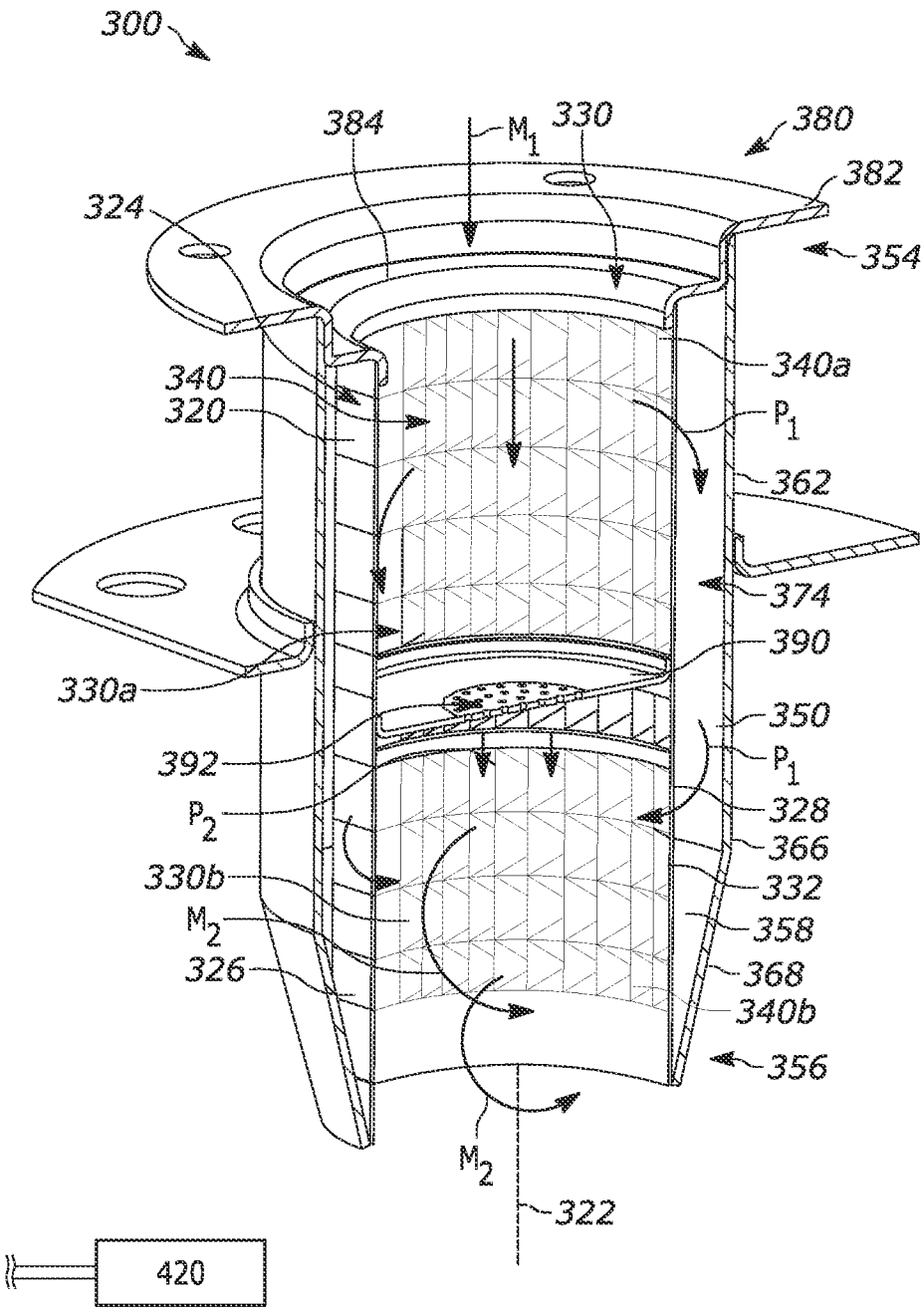
FIG. 7B is a section view taken along line 7B-7B of FIG. 7A.
Figure 8:
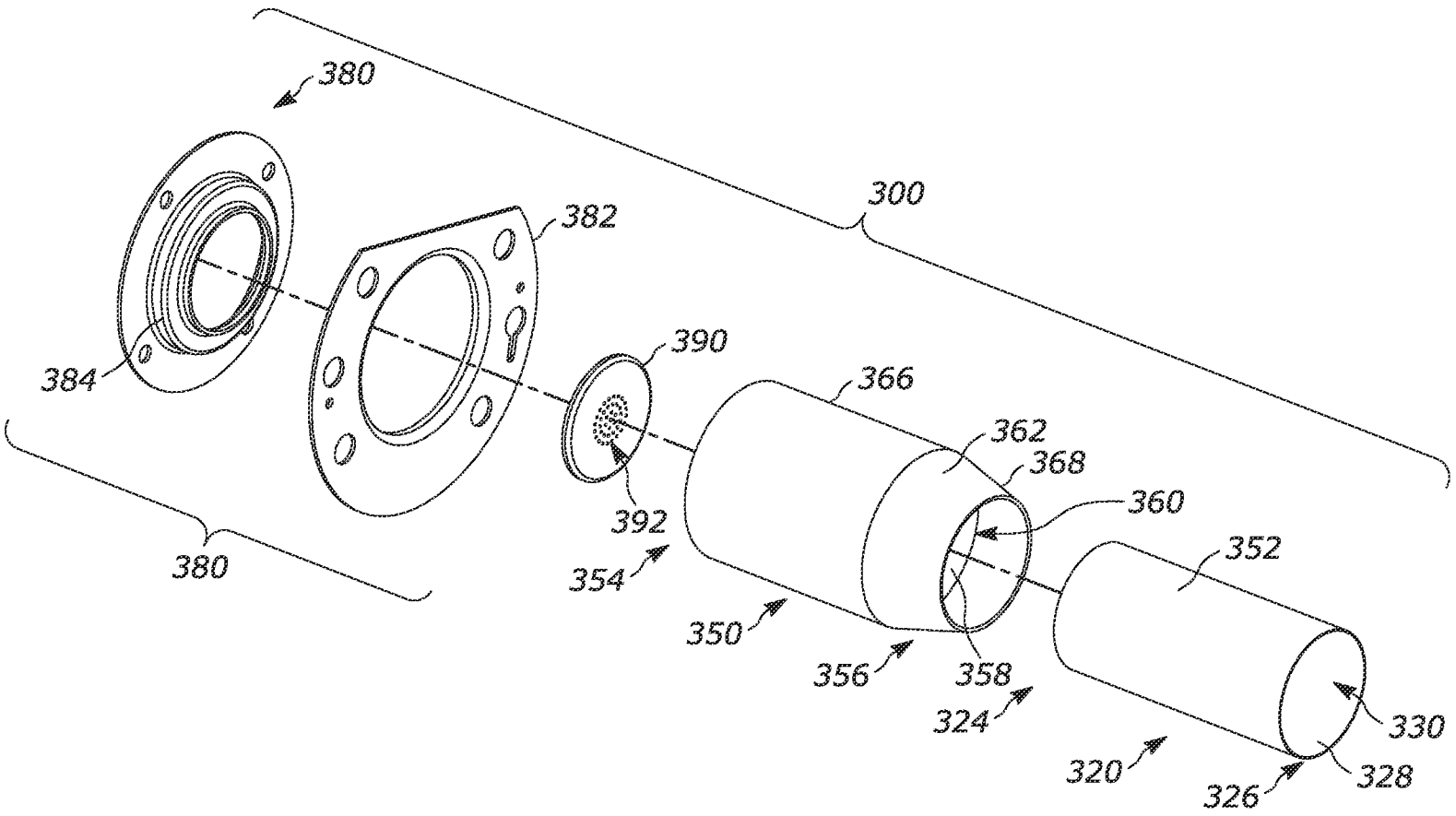
FIG. 8 is an exploded view of the combustor of FIG. 7A.

Another example combustor 300 is illustrated in FIGS. 7A-8. Features in FIGS. 7A-8 that are identical to features in FIGS. 1-6B are given the same reference number. In FIG. 7A, the combustor 300 includes a first, inner tube 320 and a second, outer tube 350. The inner tube 320 and the outer tube 350 are concentric with one another and are centered about a central axis 322. The inner tube 320 extends along the central axis 322 from a first/upstream end 324 to a second/downstream end 326. Although the inner tube 320 is illustrated as having a circular shape, it will be appreciated that the inner tube can exhibit alternative shapes, such as triangular, square, oval, any polygonal shape or combinations thereof along its length.

Referring to FIG. 7B, the inner tube 320 includes an inner surface 328 and an outer surface 332. The inner surface 328 defines a central passage or interior space 330 extending the entire length of the inner tube. The inner tube 320 has a constant cross-section as illustrated in FIG. 1. Alternatively, the inner tube 320 can have a cross-section that varies (not shown), e.g., is stepped, tapered, etc., in one or more directions along the central axis 322. Regardless, the inner tube 320 is made from a durable, flame-resistant material, such as metal.

The outer tube 350 extends along the central axis 322 from a first end 354 to a second end 356. Although the outer tube 350 is illustrated as having round axial cross-section, it will be appreciated that the outer tube can exhibit alternative cross-sections, such as triangular, square, oval, any polygonal shape or combinations thereof along its length. The outer tube 350 includes an inner surface 358 and an outer surface 362. The inner surface 358 defines a central passage or interior space 360 extending the entire length of the outer tube.

As shown, the outer tube 350 has a cross-section that varies along the central axis 322. More specifically, the outer tube 350 includes a straight section 366 extending from the first end 354 towards the second end 356. A converging section 368 extends from the straight section 366 to the second end 356. In another example, the outer tube 350 has a constant cross-section along its central axis 322 (not shown). Regardless, the outer tube 350 is made from a durable, flame-resistant material, such as metal.

The inner tube 320 is positioned within the interior space 360 of the outer tube 350. The space between the inner and outer tubes 320, 350 defines a fluid passage 374. An end wall 380 is connected to the first ends 324, 354 of the tubes 320, 350 to close the upstream end of the fluid passage 374. To this end, the end wall 380 includes a planar base 382 and a stepped or contoured portion 384 that extends into the first ends 324, 354 to block the upstream end of the fluid passage 374 in a fluid-tight manner. The end wall 380 can be formed from two pieces (as shown) secured together in a fluid-tight manner or one piece (not shown). The converging section 368 of the outer tube 350 is secured to the second end 326 of the inner tube 320 in a fluid-tight manner to close the downstream end of the fluid passage 374.

That said, the central passage 330 of the inner tube 320 is configured to receive a pre-mixed mixture $M_1$ of fuel and air delivered to the combustor 330 in a conventional manner known in the art. The periphery of the inner tube 320 includes fluid directing structures 340 for controlling how the pre-mixed mixture M flows through the combustor 330, as will be discussed.

A partition 390 is provided in the central passage 330 and divides the central passage into a first/upstream section 330*a* and a second/downstream section 330*b*. The partition 390 can be positioned substantially at the longitudinal center of the inner tube 320. Other longitudinal positions for the partition 390 are contemplated, e.g., further upstream or further downstream. The periphery of the partition 390 can optionally form a fluid-tight seal with the inner surface 328 of the inner tube 320. The partition 390 can include perforations 392 arranged randomly or in a predetermined pattern providing fluid communication between the first and second sections 330*a*, 330*b* of the central passage 330. Alternatively, the perforations 392 can be omitted (not shown).

The fluid directing structures 340 are configured to direct the air/fuel mixture $M_1$ radially outward to the fluid passage 374 then radially inward back into the central passage 330. To this end, fluid directing structures 340 can include a series of openings with [optional] associated fins or guides for directing fluid in the desired manner. It will be appreciated that any of the openings and fins/guides described herein can be implemented into the combustor 300.

With this in mind, the fluid directing structures 340 can have a first configuration 340*a* upstream of the partition 390 and a second configuration 340*b* downstream of the partition. The first and second configurations 340*a*, 340*b* can be the same/substantially the same as one another (as shown) or different from one another (not shown).

In one example shown, the fluid directing structures 340*a* can be similar to the fluid directing structures 72 except the fluid directing structures 340 direct the incoming pre-mixed mixture $M_1$ radially outward instead of radially inward. More specifically, the fluid directing structures 340*a* can include openings and associated guides for directing the pre-mixed mixture $M_1$ in a desired direction. As shown, the fluid directing structures 340*a* direct a first portion $P_1$ of the pre-mixed mixture $M_1$ radially outward from the first section 330*a* of the central passage 330 to the fluid passage 374. The first portion $P_1$ can be directed downstream at a desired angle(s) relative to the central axis 322. Furthermore, the first portion $P_1$ can be directed downstream while being imparted with centrifugal motion so as to swirl or rotate around the central axis 322 (as shown) or directed to move downstream without being swirled about the central axis (not shown). The swirling motion can be in either the clockwise or counterclockwise direction about the central axis 322.

At the same time, a second portion $P_2$ of the pre-mixed mixture $M_1$ can flow axially through the perforations 392 in the partition 390 from the first section 330*a* to the second section 330*b*. The size, shape, number, and arrangement of the perforations 392 can be configured to precisely tailor how the second portion $P_2$ flows therethrough. For instance, the perforations 392 can have different sizes to provide greater flow at the center or periphery of the partition 390 relative to other locations of the partition.

The fluid directing structures 340*b* can include openings and [optionally] associated guides for directing the first portion $P_1$ from the fluid passage 374 radially inward into the second section 330*b*, i.e., downstream of the partition 390. More specifically, the fluid directing structures 340*b* can direct the first portion $P_1$ downstream of the partition 390 while being imparted with centrifugal motion so as to swirl or rotate around the central axis 322 as the first portion moves downstream. The swirling motion can be in either the clockwise or counterclockwise direction about the central axis 322. It will be appreciated that the fluid directing structures 340*a* and/or the fluid directing structures 340*b* can include guide or the guides can be omitted. Moreover, the fluid directing structures 340*a*, 340*b* can cause the first portion $P_1$ to swirl in the same direction about the central axis 322 or in opposite directions.

With this in mind, since the converging section 368 of the outer tube 350 closes the downstream end of the fluid passage 374, the first portion $P_1$ is forced to exit the fluid passage through the fluid directing structures 340*b*. In other words, no amount of the first portion $P_1$ exits the fluid passage 374 at the axial extents of the second ends 326, 356.

In any case, directing the first portion $P_1$ from the fluid passage 374 to the second section 330*b* causes the first portion $P_1$ to recombine and mix with the second portion $P_2$ passing through the perforations 392 to form a second mixture $M_2$. More specifically, the swirling first portion $P_1$ entrains the second portion $P_2$ to form a collective second mixture $M_2$ that is ignited within the second section 330*b* by an igniter (not shown). Consequently, the second section 330*b* defines the combustion chamber of the combustor 300.

That said, the flame and combustion products from the ignited air/fuel second mixture $M_2$ exit the combustor 300 swirling about the central axis 322 as indicated generally by arrows in FIG. 7B. Flame proving means (not shown) can be positioned in any number of suitable locations to detect the presence of the resulting flame. A controller 420 is connected to the igniter, blower, and flame proving means for monitoring/operating the same.

Directing the first portion $P_1$ via the fluid directing structures 340*a*, 340*b*—whether with swirling or without swirling—advantageously helps to balance and stabilize the flow of the second mixture $M_2$ while also promoting further mixing thereof. This helps to provide improved flame stability when the second mixture $M_2$ is ultimately ignited by the igniter. Furthermore, providing perforations 392 that allow a relatively smaller volume of the second portion $P_2$ [compared to the volume of the first portion $P_1$] to flow through the partition 390 helps to cool the partition while further enhancing flame stability.

The preferred embodiments of the invention have been illustrated and described in detail. However, the present invention is not to be considered limited to the precise construction disclosed. For example, it will be understood that any of the combustors described above can incorporate a "variable volume" combustion chamber, e.g., fluid passage, by configuring the wall 100 secured to the inner tube (shown in FIG. 2) or the partition 390 secured to the inner tube 320 (FIG. 7A) to be movable along the respective central axis 14, 322. This can be manually accomplished or adjusted via motor/linear actuator connected to the controller (not shown). Such a construction would allow for optimized combustion performance by matching the combustion chamber volume to the power output required.

Those skilled in the art will recognize that the principles of this invention can be applied to burners used in heating appliances such as hot water tanks, furnaces and boilers. The principals of this invention can also be used in non-appliance applications, such as in jet engines. Those skilled in the art will recognize that the disclosed burner configurations can be adapted for use in the identified heating applications.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A combustor, comprising:

an outer tube having an interior space extending between first and second openings;

and an inner tube within the interior space extending along a centerline from a first end to a second end and defining a central passage, the first end being closed by an end wall in a fluid-tight manner, the interior space being supplied with a mixture of air and combustible fuel pre- mixed upstream of the inner tube, the inner tube having fluid directing structures for directing the pre-mixed mixture radially inward from the interior space to the central passage such that the pre-mixed mixture converges towards the central axis centerline in a direction extending towards the second end of the inner tube, wherein the fluid directing structures includes a plurality of openings and a guide associated with each opening, the guides being angled relative to an outer surface of the inner tube and extending in a downstream direction angled inward toward the centerline such that the pre-mixed mixture converges in the direction extending towards the second end of the inner tube.

2. The combustor of claim 1, wherein the guides are arranged in a series of rows extending the length of the inner tube and positioned around the periphery of the inner tube to encircle the central axis centerline.

3. A combustor, comprising:

an outer tube having an interior space extending between first and second openings;

and an inner tube within the interior space extending along a centerline from a first end to a second end and defining a central passage, the first end being closed by an end wall in a fluid-tight manner, the interior space being supplied with a mixture of air and combustible fuel pre-mixed upstream of the inner tube, the inner tube having fluid directing structures for directing the pre-mixed mixture radially inward from the interior space to the central passage such that the pre-mixed mixture converges towards the central axis centerline in a direction extending towards the second end of the inner tube, wherein the fluid directing structures includes a plurality of openings having a depth extending in a direction that is angled relative to an outer surface of the inner tube such that the pre-mixed mixture converges in the direction extending towards the second end of the inner tube.

4. The combustor of claim 1, wherein an end wall closes the first end of the inner tube such that the fluid directing structures on the inner tube provides a fluid path from the interior space to the central passage.

5. The combustor of claim 1 further comprising a flange for securing the second end of the inner tube to the outer tube in a fluid-tight manner.

6. The combustor of claim 1, wherein the combustor produces about 10 ppm of total $NO_x$ at about 10% $CO_2$.

7. A heating appliance including the combustor of claim 1.

8. A combustor, comprising:

an outer tube defining an interior space extending between first and second openings;

an inner tube within the interior space extending along a centerline from a first end to a second end and defining a central passage, the interior space being supplied with a mixture of air and combustible fuel pre-mixed upstream of the inner tube, the inner tube having fluid directing structures for directing the pre-mixed mixture radially inward from the interior space to the central passage such that the pre-mixed mixture converges towards the central axis centerline in a direction extending towards the second end of the inner tube, wherein the fluid directing structures includes a plurality of openings and a guide associated with each opening, the guides being angled relative to an outer surface of the inner tube and extending in a downstream direction angled inward toward the centerline such that the pre-mixed mixture converges in the direction extending towards the second end of the inner tube;

an end wall for securing the first end of the inner tube to the outer tube in a fluid-tight manner such that the fluid directing structures on the inner tube provides a fluid path from the interior space to the central passage; and a flange for securing the second end of the inner tube to the outer tube in a fluid-tight manner.

9. A heating appliance including the combustor of claim 8.

10. A combustor for an appliance, comprising:

an inner tube extending along a central axis and defining a central passage and including fluid directing structures arranged circumferentially about the inner tube;

an outer tube extending along the central axis and defining a central passage for receiving the inner tube, a fluid passage being defined between the inner and outer tubes;

a partition dividing the central passage of the inner tube into a first section and a second section and having perforations providing fluid communication between the first and second sections;

an end wall for closing the fluid passage at the first ends of the inner and outer tubes;

wherein the first end of the inner tube receives a pre-mixed mixture of air and combustible fuel such that a first portion of the pre-mixed mixture flows radially outward through the fluid directing structures into the fluid passage and then radially inward into the second section of the central passage downstream of the partition while a second portion of the mixture flows axially from the first section through the perforations to the second section such that the first and second portions of the mixture mix within the second section for ignition by an igniter.

11. The combustor of claim 10, wherein the second end of the outer tube converges to close the fluid passage at the second end of the inner tube.

12. The combustor of claim 10, wherein the fluid directing structures directs the pre-mixed mixture radially into the second section without imparting a swirling motion in the pre-mixed mixture.

13. The combustor of claim 10, wherein the fluid directing structures directs the pre-mixed mixture radially into the second section while imparting a swirling motion in the pre-mixed mixture such that the pre-mixed mixture rotates within the second section about the central axis.

14. The combustor of claim 10, wherein the fluid directing structures upstream of the partition is identical to the fluid directing structures downstream of the partition.

15. The combustor of claim 10, wherein the fluid directing structures upstream of the partition is different from the fluid directing structures downstream of the partition.

16. The combustor of claim 10, wherein the fluid directing structures upstream of the partition swirls the mixture in a first direction about the central axis and the fluid directing structures downstream of the partition swirls the mixture in a second direction opposite the first direction.

17. The combustor of claim 10, wherein the fluid directing structures upstream of the partition swirls the mixture in a first direction about the central axis and the fluid directing structures downstream of the partition swirls the mixture in the first direction.

18. The combustor of claim 10, wherein the fluid directing structures upstream of the partition is formed from a separate piece from the fluid directing structures downstream of the partition.

19. The combustor of claim 10, wherein:

first fluid directing structures on the inner tube are positioned upstream of the partition for directing the pre-mixed mixture outward from the first section to a fluid passage radially between the inner and outer tubes;

second fluid directing structures on the inner tube positioned downstream of the partition for directing the pre-mixed mixture radially inward from the fluid passage to the second section.

20. A heating appliance including the combustor of claim 10.

21. The combustor of claim 1, wherein the fluid directing structure directs the pre-mixed mixture radially into the central passage without imparting a swirling motion in the pre-mixed mixture.

22. The combustor of claim 8, wherein the fluid directing structure directs the pre-mixed mixture radially into the central passage without imparting a swirling motion in the pre-mixed mixture.

23. The combustor of claim 10, wherein the pre-mixed mixture flows radially outward through the fluid directing structures in the first section of the central passage upstream of the partition to exit the central passage and then radially inward through the fluid directing structures in the second section of the central passage downstream of the partition to re-enter the central passage.

24. A combustor, comprising:

an outer tube having an interior space extending between first and second openings; and an inner tube within the interior space extending along a centerline from a first end to a second end and defining a central passage, the first end being closed by an end wall in a fluid-tight manner, the interior space being supplied with a mixture of air and combustible fuel pre-mixed upstream of the inner tube, the inner tube having fluid directing structures for directing the pre-mixed mixture radially inward from the interior space to the central passage such that the pre-mixed mixture converges towards the centerline without imparting a swirling motion in the pre-mixed mixture.

* * * * *